US008675884B2

(12) United States Patent
Yehuday et al.

(10) Patent No.: US 8,675,884 B2
(45) Date of Patent: Mar. 18, 2014

(54) METHOD AND A SYSTEM FOR PROCESSING SIGNALS

(75) Inventors: Uri Yehuday, Bat Yam (IL); Arie Heiman, Raanana (IL)

(73) Assignee: DSP Group, San Jose, CA (US)

( * ) Notice: Subject to any disclaimer, the term of this patent is extended or adjusted under 35 U.S.C. 154(b) by 445 days.

(21) Appl. No.: 12/990,647

(22) PCT Filed: May 24, 2009

(86) PCT No.: PCT/IL2009/000513

§ 371 (c)(1),
(2), (4) Date: Feb. 22, 2011

(87) PCT Pub. No.: WO2009/141828

PCT Pub. Date: Nov. 26, 2009

(65) Prior Publication Data

US 2011/0135106 A1 Jun. 9, 2011

Related U.S. Application Data

(60) Provisional application No. 61/055,176, filed on May 22, 2008.

(51) Int. Cl.
*G10K 11/16* (2006.01)

(52) U.S. Cl.
USPC ..... 381/71.6; 381/151; 181/129; 181/130

(58) Field of Classification Search
USPC ..... 381/151, 57, 94.1, 122, 71.6, 71.1, 328, 381/380, 382; 181/129–135, 196–198
See application file for complete search history.

(56) References Cited

U.S. PATENT DOCUMENTS

| | | | | |
|---|---|---|---|---|
| 5,933,506 | A * | 8/1999 | Aoki et al. | 381/151 |
| 6,175,633 | B1 | 1/2001 | Morrill et al. | |
| 6,396,930 | B1 | 5/2002 | Vaudrey et al. | |
| 2007/0127757 | A2 | 6/2007 | Darbut et al. | |
| 2008/0253594 | A1 * | 10/2008 | Rasmussen et al. | 381/312 |
| 2009/0190771 | A1 * | 7/2009 | Sung | 381/71.6 |

* cited by examiner

*Primary Examiner* — Vivian Chin
*Assistant Examiner* — Friedrich W Fahnert
(74) *Attorney, Agent, or Firm* — McAndrews, Held & Malloy, Ltd.

(57) ABSTRACT

A system for processing sound, the system including: (a) a processor, configured to process a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals; and (b) a communication interface, configured to provide the corrected signal to an external system.

36 Claims, 13 Drawing Sheets

800

1000

1200

METHOD AND A SYSTEM FOR PROCESSING SIGNALS

CROSS REFERENCE TO RELATED APPLICATIONS

This application claims the benefit of U.S. Ser. No. 61/055,176, filed on 22 May 2008 (and entitled "Method and Apparatus for Reducing Ambient Noise for Mobile Devices by Using Combination of Auditory Signal, Microphones and Bone Conduction Speakers"), which is incorporated in their entirety herein by reference.

BACKGROUND OF THE INVENTION

Mobile phone become very popular, people use it in various noisy environments. In noisy environment the microphone pickup the speech signal of the user combined with the ambient noise. In cases where the ambient noise is very high the receiver of the signal in the far end, receives a degraded speech and in extreme cases the speech cannot understood. At the near end due to the ambient noise the user in some cases can not hear well the speech that the far end speaks.

There are different techniques and products that reduce the effect of the ambient noise. Some use a single Microphone where during silence periods of the near end user, the ambient noise is estimated and it is used to reduce the noise during the speech periods.

Other techniques use two microphones where one is designed to pick the speech combined with the ambient noise. The second one is designed to pick up mainly the ambient noise.

The prior art techniques are not effective enough, and require massive computations. There is a need for simple and efficient means of processing signals.

SUMMARY OF THE INVENTION

A system for processing sound, the system including: (a) a processor, configured to process a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals; and (b) a communication interface, configured to provide the corrected signal to an external system.

A method for processing sound, the method including: (a) processing a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals; and (b) providing the corrected signal to an external system.

A system for processing sound, the system including: (a) a processor configured to process a first input signal that is detected by a first microphone at a detection moment, and a second input signal that is detected at the detection moment by a second microphone which is placed at least partly within an ear of a user, to generate a corrected signal that is responsive to the first, and the second input signals; and (b) a communication interface for providing the corrected signal to an external system.

A method for processing sound, the method including: (a) processing a first input signal that is detected by a first microphone at a detection moment, and a second input signal that is detected at the detection moment by a second microphone which is placed at least partly within an ear of a user, to generate a corrected signal that is responsive to the first, and the second input signals; and (b) providing the corrected signal to an external system.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
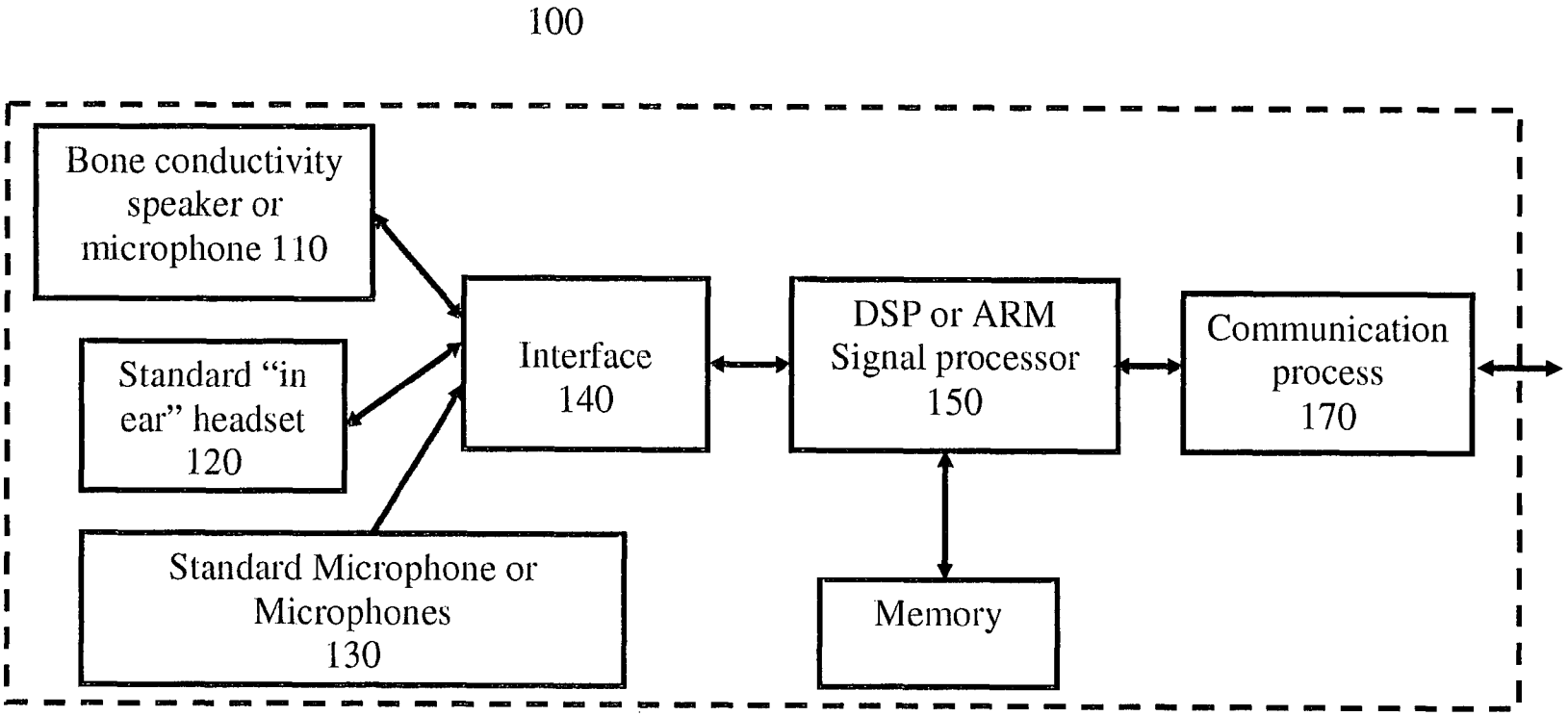
FIG. 1 illustrates a system for processing signals, according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The systems and methods herein disclosed may be used for example, according to some implementations of which, for reducing ambient noise for mobile devices by using combination of auditory signal, microphones and bone conduction speakers or microphones. Other uses (some of which are provided as examples) may also be implemented.

According to several implementations, the herein disclosed systems and methods utilize multiple microphones to collect the speech and the ambient noise. In order to reduce the implementation cost and or complexity, some of the microphones may not dedicated microphones and speakers may also be used, according to an embodiment of the invention, as microphones.

It must be noted that the herein disclosed system and methods may be generalized to use different configuration or number of speaker or microphones than described in relation to the figures—e.g. in order to improve the reduction of the noise—without extending out of the scope of the invention.

FIG. 1 illustrates system 100 for processing signals, according to an embodiment of the invention. System 100 may be implemented, for example, in a mobile phone for reducing ambient noise in near end, in a Bluetooth headset, in a wired headset, and so forth.

System 100 is a system that may perform the ambient noise reduction in the far end during the phone conversation. System 100 may include some or all of the following components. Block 150 is a Signal Processor such as DSP or ARM with memory 160 that is commonly used in mobile phones. The DSP receive the multi microphone information via interface 140. Interface 140 may conveniently be an analog to digital conversion devices that digitize the signal and fed it to signal processor 150, as well as it consist of digital to analog conversion modules that delivers to the relevant speakers the appropriate speech signals received from signal processor 150. In signal processor 150 the signal processor process the multi channel microphones as described in relation to FIG. 3 (and system 300). The reduced noise signal is fed to 170, where the speech is compressed and sent to the far end user via the digital modem.

According to an embodiment of the invention, signal processor 150 and 170 may be combined into one block.

110 includes one or more bone conduction microphones, which can be dedicated bone conduction microphones or bone conduction speakers that are used also as a microphone. The analog signal with the appropriate amplification is fed to 140.

120 includes one or more "in ear" speakers that user plug into the ear canal, or other types of speakers. These speakers may normally be used to listen to the far end user or listen to music that is played by system 100 or another system. Those "in ear" speakers may be used, according to an embodiment of the invention, as a microphone to collect the signal that is heard in the ear canal. The analog signal with the appropriate amplification is fed to 140.

130 includes one or more a microphone (e.g. such as the microphone that mobile phone use to pick up the speech of the user). The analog signal with the appropriate amplification is fed to 140.

The cancellation process of the noise for the far and for the near end user can be formulated, according to an embodiment of the invention, by the following equations, assuming that we use only the following 3 inputs:

1. "in ear" speaker
2. Standard microphone
3. Bone conduction microphone

The signal that is detected in the standard microphone M1(*n*) can described by $$M_1(n)=s(n)+d(n)+n_1(n)$$

Where s(n) is the speech produced by the near end user d(n) is the ambient noise in the near end $n_1(n)$ is noise of the pickup equipment The signal $M_2(n)$ that is detected by the microphone 120 (e.g. a speaker that is used as microphone to pick the speech of the user propagated via the bone) obeys the following equation:

$$M_2(n)=\alpha(n)*s(n)+\beta(n)*d(n)+n_2(n)$$

Where α(n) is a filter that the speech undergoes during its propagation via the bone, and β(n) is the gain or a filter that reduce the amount of ambient noise that is detected by the "in ear" speakers. n2(*n*) is noise of pickup equipment. It is noted that throughout this disclosure, the symbol * denotes a convolution operation.

It must be noted that due to the fact that the "in ear" plug blocks the ear canal, in such an implementation the speech signal that is produced by the near end user and propagates via the bone, undergo an occlusion effect that increase the low frequencies of the speech by 15-20 db. This means that α>>1

In addition the "in ear" blocks significantly the ambient noise namely β(n)<<1. Unlike standard system that use two microphones.

Bone conduction microphone 110, which may be attached to the skull of the user, may pick the speech of the user via the vibration of the bone. The bone conduction microphone is conveniently not sensitive to the ambient noise hence $$M_3(n)=\chi(n)*s(n)+n_3(n)$$

Where χ(n) is a low pass filter that models the bone conduction microphone characteristics, and n3(*n*) is noise of pickup equipment. Hence $$M_1(n)=s(n)+d(n)+n_1(n)$$

$$M_2(n)=\alpha(n)*s(n)+\beta(n)*d(n)+n_2(n)$$

$$M_3(n)=\chi(n)*s(n)+n_3(n)$$

According to an embodiment of the invention, processor 150 is configured to estimate the original speech s(n) and the ambient noise d(n), wherein the estimations are denoted as $\hat{S}(n)$ and $\hat{d}(n)$ respectively.

According to an embodiment of the invention, $\hat{S}(n)$ is the signal that will be transmitted to the far end user (possibly after compression).

According to an embodiment of the invention that is discussed below, $\hat{d}(n)$ may be used to reduce the noise in the ear canal of the near end user.

According to an embodiment of the invention, the user will use a stereo headset where from each side of the ear $\hat{d}(n)$ is subtracted. Such a cancellation may be very effective.

Figure 4:
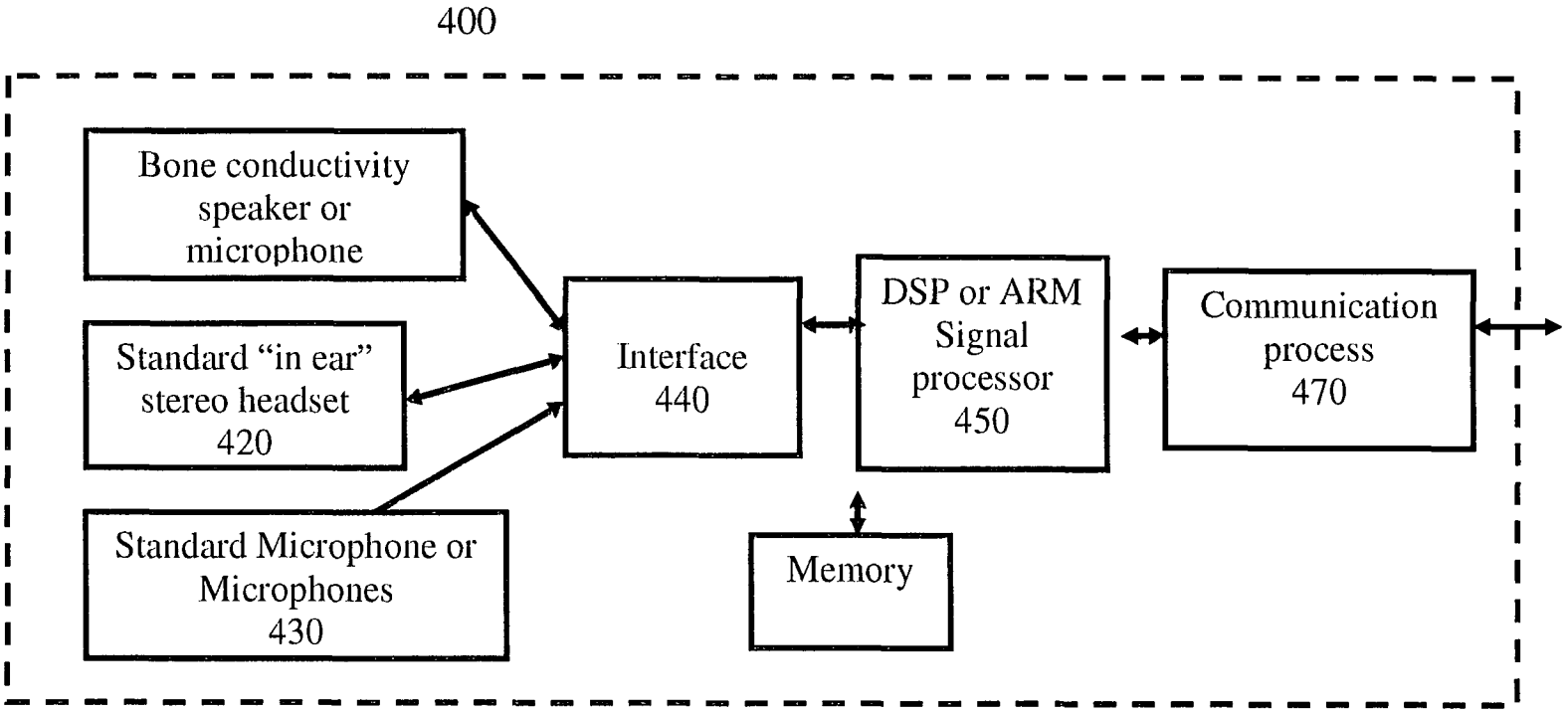
FIG. 4 illustrates a system according to an embodiment of the invention.

A system that reduces the ambient noise for a local user is described in relation to FIG. 4.

In cases where n1=n2=0

$$M_1(n)=s(n)+d(n)$$

$$M_2(n)=\alpha(n)*s(n)+\beta(n)*d(n)$$

$$M_3(n)=\chi(n)*s(n)$$

In ideal case the measurement of $M_3(n)$ is not necessary and $\hat{S}(n)$ can be calculated $$\hat{S}(n)=[M_2(n)-\beta(n)*M_1(n)]*inv(\alpha(n)-\beta(n))$$

Where α(n) and β(n) can be calculated during calibration process. In a case where the bandwidth of χ(n) is wide and cover all the speech frequency range $$\hat{S}(n)=M_3(n)*inv(\chi(n))$$

In cases where $n_1$, $n_2$ and $n_3$ are not zero than s(n) can be estimated by various known MMSE (Minimum Mean Square Error) technique.

According to an embodiment of the invention, one alternative for calculating of $\hat{S}(n)$ and $\hat{d}(n)$ by processor 150 is disclosed.

Let estimate $\hat{S}(n)$ by $$\hat{s}(n)=h_1(n)*M_1(n)+h_2(n)*M_2(n)+h_3(n)*M_3(n)$$

Let denote e(n) as the estimation error namely:

$$e(n)=\hat{s}(n)-s(n)$$

Hence the mean square error J is:

$$J=E(e^2)$$

$$J=E\{[h1(n)*M1(n)+h2(n)*M2(n)+h3(n)*M3(n)-s(n)]^2\}$$

Where E{ } is the mean operator.

Hence $$\partial J/\partial h_i=2e(n)M_i(n)$$

Where in our case i=1, 2, 3

Figure 3:
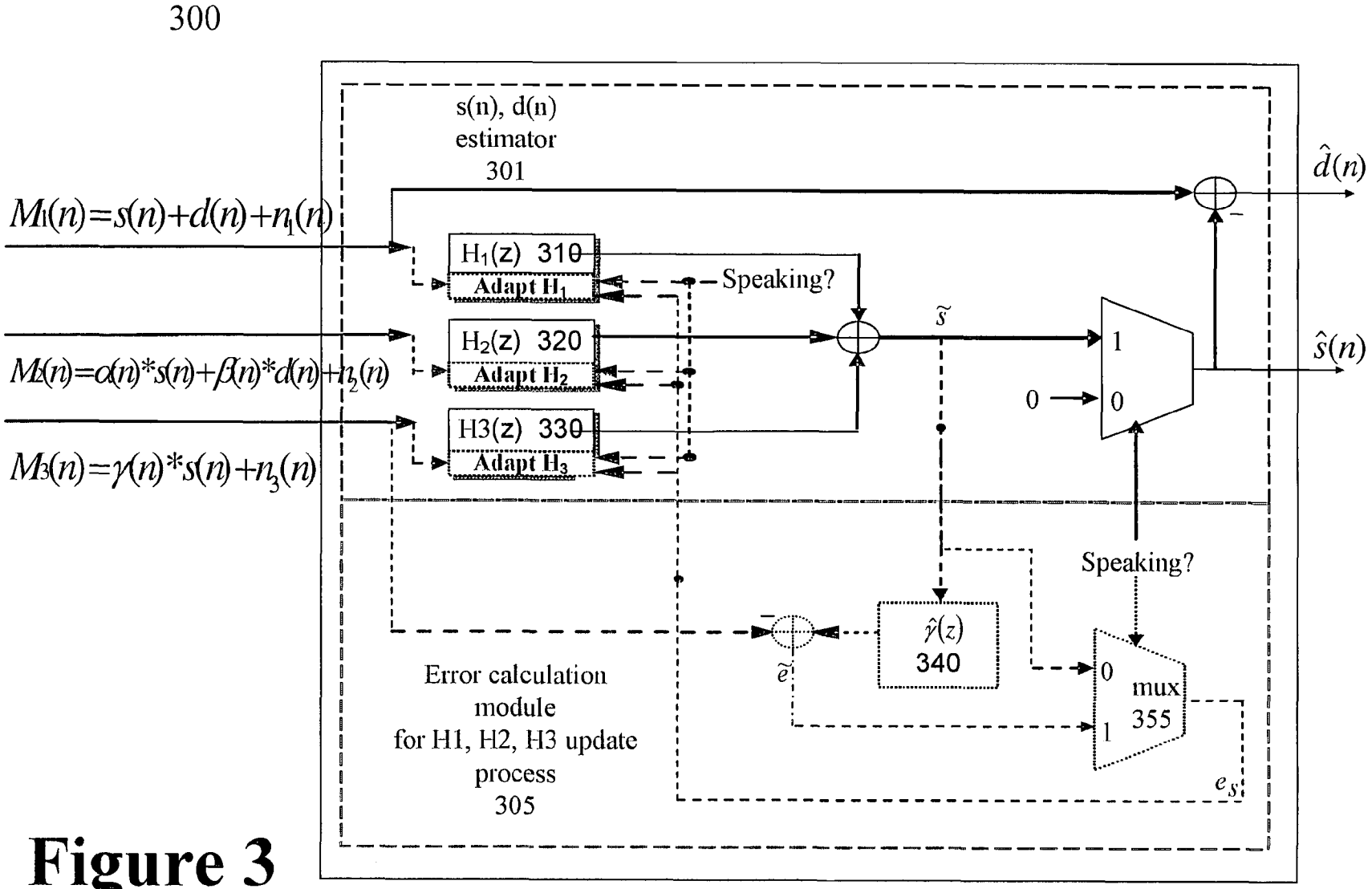
FIG. 3 illustrates a processor and a corresponding process, according to an embodiment of the invention.

Following this one can calculate $h_1(n)$, $h_2(n)$ and $h_3(n)$ by adaptation process as described in relation to FIG. 3.

It must be noted that during the adaptation process there are period of time that the near end user is silent namely s(n)=0, during this period of time one of the filters (e.g. $h_1(n)$) needs to be freeze, otherwise the adaptation will end up with $h_1(n)=h_2(n)=h_3(n)=0$ which is an undesired solution.

To avoid adaptation at silence a speech detection mechanism may be used. There are different mechanisms that can be used. We present two different mechanisms that may be implemented (together or separately) in different embodiments of the invention.

In case where an "in ear" speaker is used one can analyze the energy of $M_2(n)$ at low frequencies, if the energy is high it indicates that the user is speaking, this indication is due to occlusion effect which boost significantly the low frequency of the speech that is propagating via the bone. Such an implementation is discussed in relation to FIG. 2A.

An alternative approach can be used in the case that bone conduction microphone or speakers are used. This device detects a low pass version of speech and almost don't detects the ambient noise. Hence by detecting the energy of $M_3(n)$ or by analyzing its spectrum amplitude per each frequency one can decide if the user is speaking or not. Such an implementation is discussed in relation to FIG. 2B.

Figure 2A:
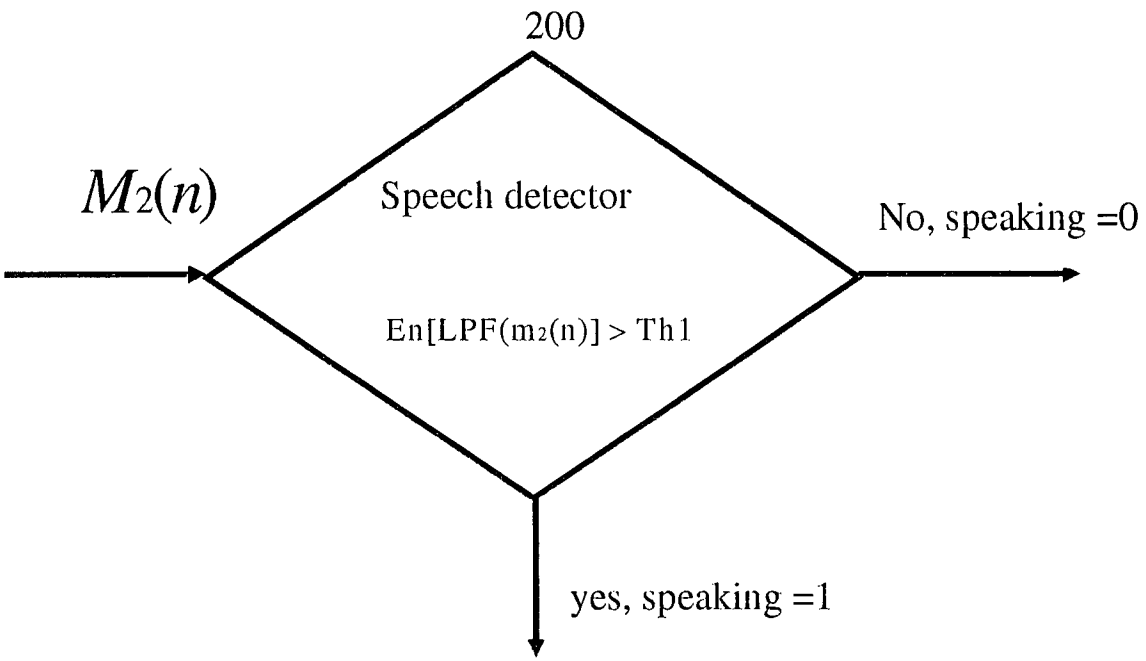
FIG. 2A illustrates a detector, according to an embodiment of the invention.

FIG. 2A illustrates detector 200, according to an embodiment of the invention. Detector 200 may be implemented, according to an embodiment of the invention, in system 100 (and may and may not be a part of processor 150). Detector 200 is a detector that calculates the energy of low frequencies of $M_2(n)$ (e.g. every speech frame of T ms) by filtering $M_2(n)$ with a LPF (low pass filter). If the energy is above a predefined threshold the frame is declared as a speech frame otherwise it is declared as a silence frame and its output is 1 or 0.1 when it is a speech frame. This process can be implemented by the DSP 150.

Figure 2B:
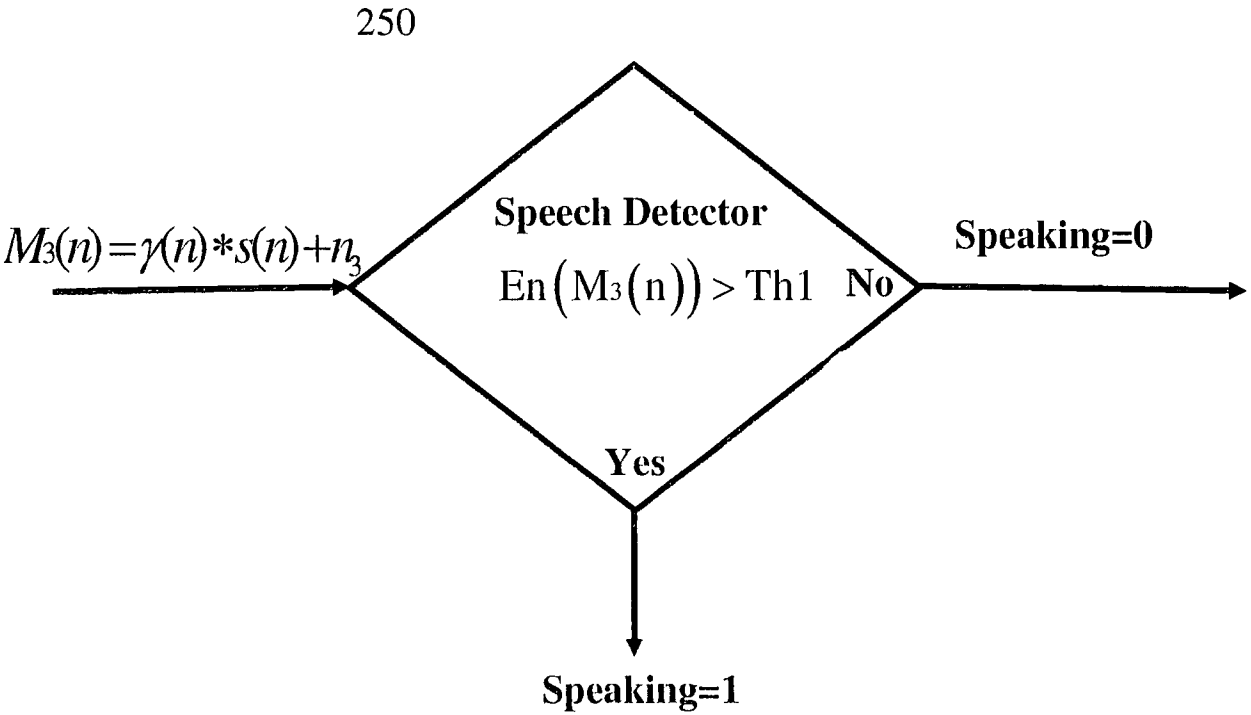
FIG. 2B illustrates a detector, according to an embodiment of the invention.

FIG. 2B illustrates detector 250, according to an embodiment of the invention. Detector 250 may be implemented, according to an embodiment of the invention, in system 100 (and may and may not be a part of processor 150). Detector 250 is a detector that calculates the energy of $M_3(n)$ (e.g. every speech frame of T ms), if the energy at this frame is above a predefined threshold the frame is declared as a speech frame otherwise it is declared as a silence frame and its output is 1 or 0.1 when it is a speech frame. This process can be implemented by the DSP 150.

The estimation of s(n) and d(n) is implemented by signal processor 150 and an implementation of which is presented in relation to FIG. 3.

FIG. 3 illustrates processor 300—and a corresponding process—according to an embodiment of the invention. Processor 300 may be used, for example, as processor 150, processor 450, as a processor 750, or as processor 950. The corresponding process may be implemented in method 1100. The components of processor 300 may be divided into two main blocks 301 and 305. Block 301 is used for estimating the signal $\hat{s}(n)$ and $\hat{d}(n)$. M1(*n*) is fed to 310, M2(*n*) is fed to 320 and m3(*n*) is fed to 330, the sum of the 3 filters output is $\tilde{s}(n)$, where $H_k(z)$ is the transform Z of $h_k(n)$ k=1, 3. Multiplexer (Mux) 350 choose the final estimation of $\hat{s}(n)$, it depends if the processed frame is a speech frame or a silence frame. In the case that it is a speech frame $\hat{s}(n)=\tilde{s}(n)$, otherwise $\hat{s}(n)=0$. The decision if frame is speech or silence is calculated as described in 200 or 250.

Block 305 is the block that updates the values of the filters $h_1(n)$, $h_2(n)$, $h_3(n)$. The adaptation process is based on $\partial J/\partial h_i=2e(n)M_i$ i=1, 2, 3, hence the estimation error need to be calculated. The appropriate error is chosen by the mux 355. In speech frame the error
is calculated by using filter 340 and is $$\tilde{e}(n)=\hat{\gamma}(n)*\tilde{s}(n)-M_3(n)$$

In silence frame, the error signal is $\tilde{s}(n)$.

It must be noted that the switch of speech/silent frame, can also be used according to an embodiment of the invention to change the adaptation weights (step size) in 310, 320, and 330.

All the process of 300 can be implemented in the DSP processors 150, 450, and/or 950.

FIG. 4 illustrates system 400, according to an embodiment of the invention. system 400 may be used—in addition to cancellation of the ambient noise for the far end user—for canceling the ambient noise for the local user as well, e.g. by using either stereo bone conduction speaker or an "in ear" stereo headset.

According to an embodiment of the invention, system 400 performs the ambient noise reduction in the far end and the near end during the phone conversation. Block 450 is a Signal Processor such as DSP or ARM with memory 460 that is common in most of the mobile phones. The DSP receive the multi microphone information via interface 440. 440 consist of analog to digital conversion devices that digitize the signal and fed it to 450, as well as it consist of digital to analog conversion modules that delivers the appropriate speech signal from 450 to the relevant speakers. In 450 the signal processor process the multi channel microphones as described in relation to 300 and 500. The reduced noise signal is fed to 470 where the speech is further compressed and sent to the far end user via the digital modem. The estimated ambient noise is also injected to a stereo "in ear" speakers via 440. The user needs to use stereo headset in order to reduce the ambient noise in both ears. If one chooses to use stereo bone conduction speakers the apparatus will support it via 440.

410 includes one or more bone conduction microphones, which can be dedicated bone conduction microphones or bone conduction speakers that are used also as a microphone. The analog signal with the appropriate amplification is fed into 440.

420 includes one or more microphones (which may be, according to an embodiment of the invention, "in ear" microphones that the user plugs into the ear canal, and/or speaker or speakers that are used as microphones). According to such an embodiments of the invention in which the user plug these speakers/microphones to the ear canal, are normally used to hear the speech of the far end user as well as it is used to cancel the near ambient noise for the near end user. The analog signal with the appropriate amplification is fed into 440.

430 includes one or more microphones, e.g. a microphone that mobile phone use to pick up the speech of the user, the analog signal with the appropriate amplification is fed into 440.

The cancellation process of the noise for the far end user and for the near end user can be formulated by the following equations assuming that we use the following 3 inputs 1. "in ear" speaker
2. Standard microphone
3. Bone conduction microphone According to an embodiment of the invention, processor 450 is used for estimating s(n) and d(n), the estimations of which are denoted $\hat{S}(n)$ and $\hat{d}(n)$ respectively.

$\hat{S}(n)$ is the signal that will be transmitted to the far end.

$\hat{d}(n)$ is used to reduce the noise in the ear canal of the near user.

According to an embodiment of the invention, the user will use a stereo "in ear" headset for even more effective cancellation.

Figure 5:
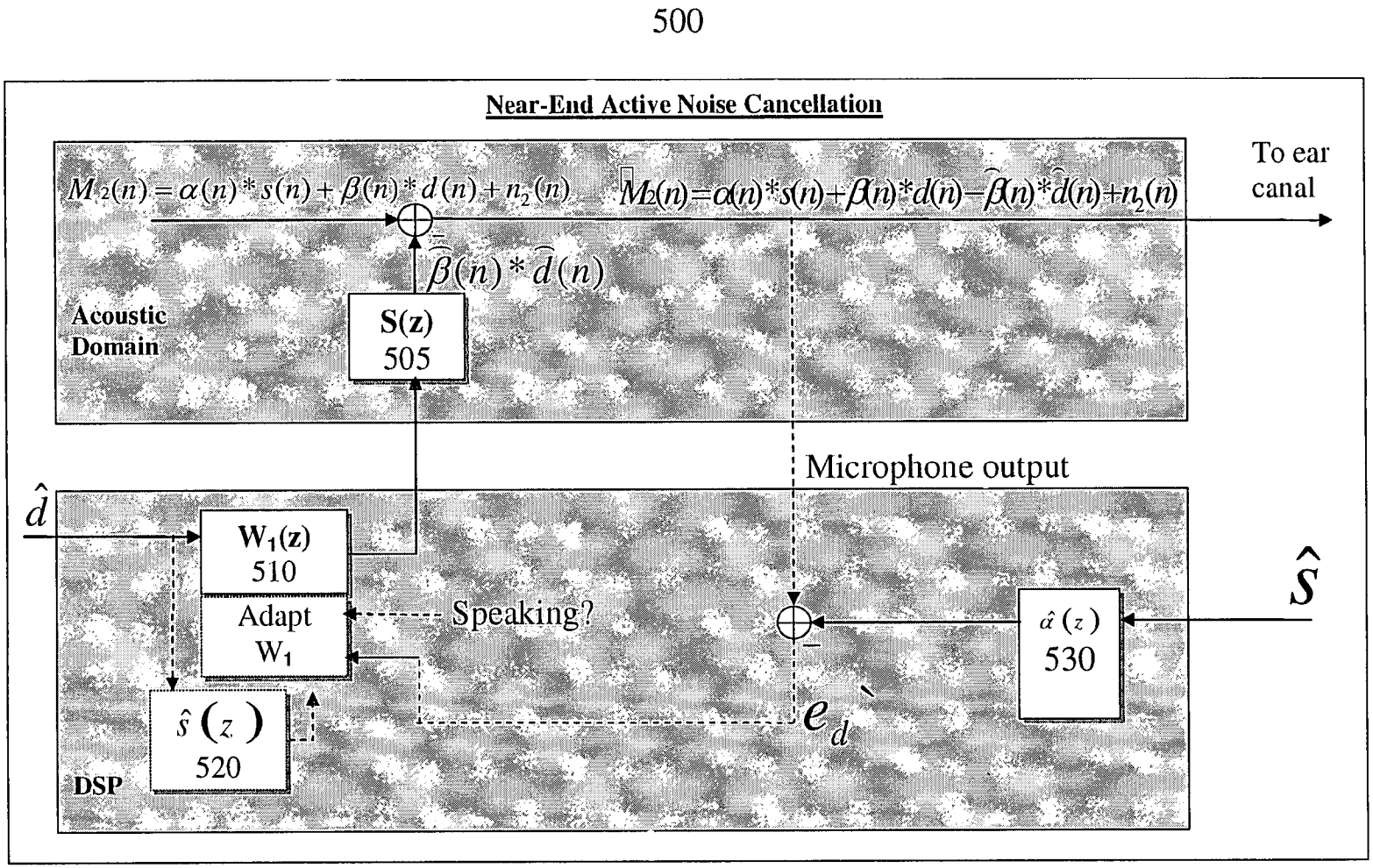
FIG. 5 illustrates a processor and a corresponding process of processing, according to an embodiment of the invention.

FIG. 5 illustrates processor 500—and a corresponding process of processing—according to an embodiment of the invention. Processor 500 may be implemented as part of processors 450, 750, and/or 950, but this is not necessarily so. The corresponding process may be implemented in method 1000. The processing of 500 can be used to cancel the ambient noise for the near end user. The outputs processor 300 are $\hat{S}(n)$ and $\hat{d}(n)$, those signals are used as input 500.

Filter 505 is used for processing signal, and may simulate, according to an embodiment of the invention, an effect of the signal in the ear canal. Following this $\hat{d}(n)$ passes through an adaptive filter W1(*z*) 510. Filter 505 may conveniently be updated such that $$W_1(z)S(z)\approx\hat{\beta}(z), \text{ hence}$$

$$M_2(n)=\alpha(n)*s(n)+\beta(n)*d(n)-\hat{\beta}(n)*\hat{d}(n)+n_2(n)$$

$$\text{If } \beta(n)*d(n)=\hat{\beta}(n)*\hat{d}(n) \text{ than}$$

$$M_2(n)=\alpha(n)*s(n)+n_2(n)$$

Which means that the user do not hear the ambient noise and hears only its own speech. If the user wants to cancel its own voice, it can be subtracted from that signal.

It must be noted that if the user will use a stereo headset he will not hear the ambient noise in both ears. If from some reason S(z) are not identical in both ears. This process can be done twice, one for each ear.

The adaptation process is done by calculating $e_d(n)$ in 530

$$e_d(n)=M2(n)-\hat{s}(n)*\hat{\alpha}(n)$$

$e_d(n)$ are used to update 510.

According to an embodiment of the invention, a speech indicator/detector (like 200 or 250) is used to adjust the adaptation weights.

In order to improve the conversion of W1(*z*), the adaptation input $\hat{d}(n)$ is filtered by estimation 520 of S(z). This method is well known in the literature and is called F×LMS method. One can use more complicated scheme to reduce the ambient noise see 600

Figure 6:
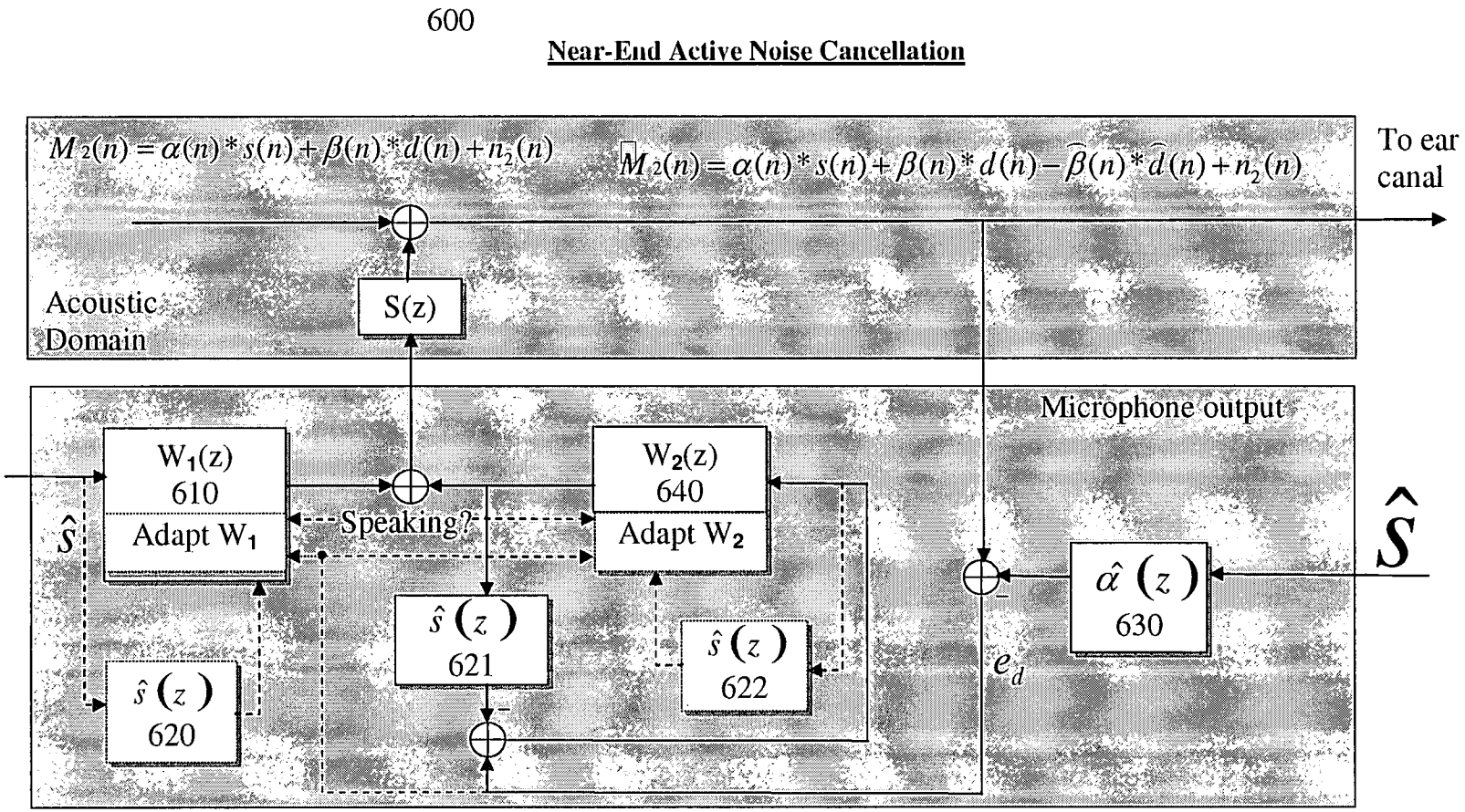
FIG. 6 illustrates a processor and a corresponding process of processing, according to an embodiment of the invention.
Figure 7:
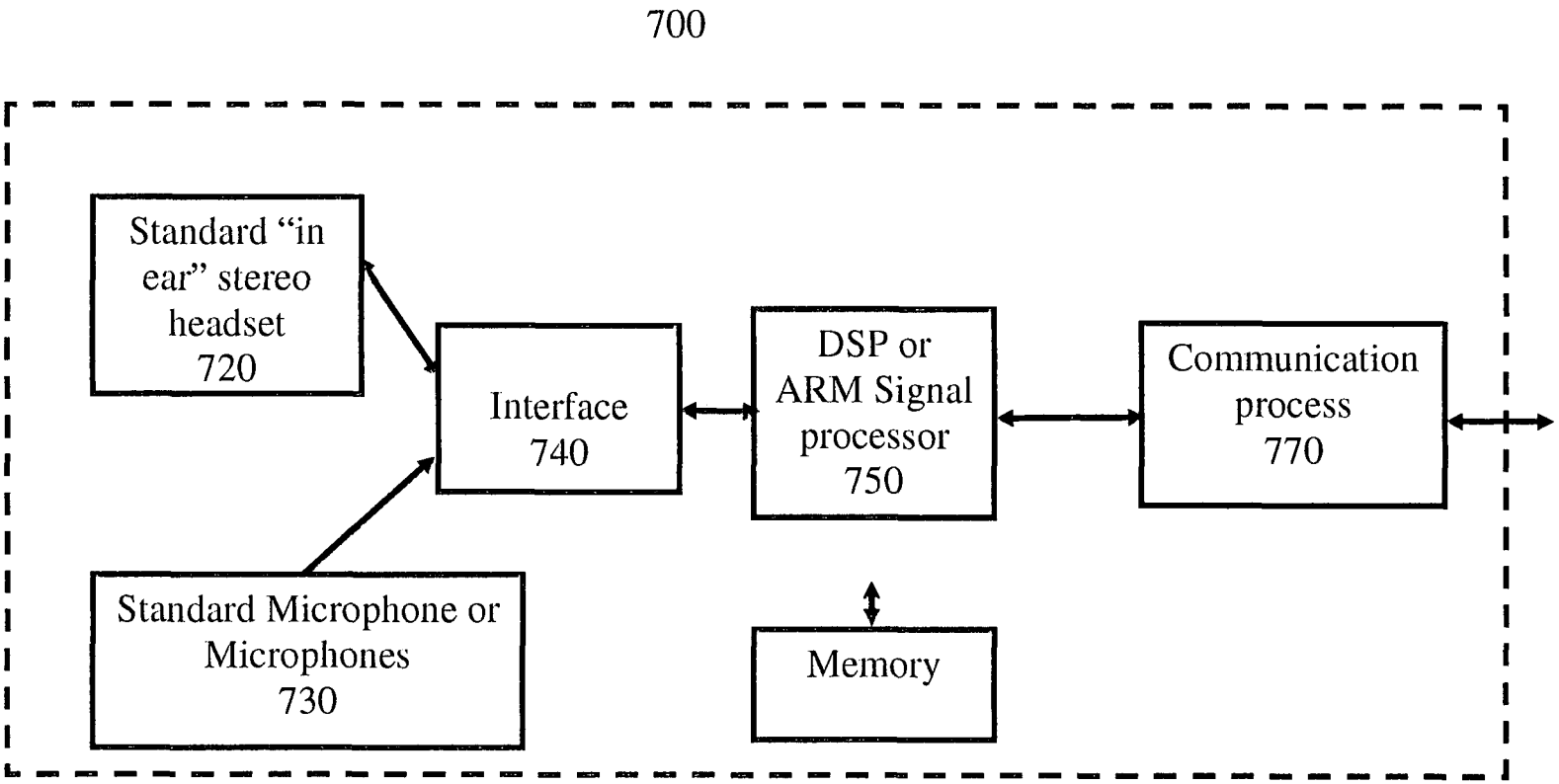
FIG. 7 illustrates a system for processing signals, according to an embodiment of the invention.

FIG. 6 illustrates processor 600—and a corresponding process of processing—according to an embodiment of the invention. Processor 600 may be implemented as part of processors 450 and/or 950, but this is not necessarily so. The corresponding process may be implemented in method 1000. The processing of 600 is similar process to 500 with additional loop that improves the estimation of $\hat{\beta}(n)*\hat{d}(n)$ FIG. 7 illustrates system 700 for processing signals, according to an embodiment of the invention. System 700 may be implemented, according to an embodiment of the invention, as a low cost apparatus can be used if instead of 3 microphones only two are used. The low cost apparatus consist of the following microphones:

1. "in ear" speaker
2. Standard microphone

System 700 may perform the ambient noise reduction in the far end and in the local end, e.g. during a noisy phone conversation. Block 750 is a Signal Processor such as DSP or ARM with memory 760 that commonly used in mobile phones. The DSP receives the two microphone information via interface 740. 740 consist of analog to digital conversion devices that digitize the signal and fed it to 750, as well as it consist of a digital to analog conversion modules that delivers the appropriate speech signal sent from 750 to the relevant speakers. In 750 the signal processor process the multi channel microphones as described in 300 and 500 but with only two microphones. The reduced noise, signal is fed to 770 where the speech is further compressed and sent it to the far user via the digital modem

720 includes one or more "in ear" microphones (which may be, according to an embodiment of the invention, speaker or speakers that user plug into the ear canal, which are normally used for listening to the far end speech or music). According to an embodiment of the invention, such "in ear" speakers may be used as microphones to collect the signal that is in the ear canal as well as we inject through these speakers the cancellation signal for the near end user. The analog signal with the appropriate amplification is fed into 740.

730 includes one or more standard microphone, e.g. a microphone used by a mobile phone use to pick up the speech of the user. The analog signal with the appropriate amplification is fed into 740.

The cancellation process of the noise for the far and the near end user can be formulated by the following equations assuming that we use only the following 2 inputs 1. "in ear" speaker
2. Standard microphone The signal that is detected in the standard microphone M1(*n*) can described by $$M_1(n)=s(n)+d(n)+n_1(n)$$

Where s(n) is the speech produced by the near end user d(n) is the ambient noise in the near end $n_1(n)$ is noise of the pickup equipment The signal $M_2(n)$ that is detected by the "in ear" speaker (that is used as microphone to pick the speech of the user propagated via the bone.) Obeys the following equation:

$$M_2(n)=\alpha(n)*s(n)+\beta(n)*d(n)+n_2(n)$$

Where α(n) is a filter that the speech undergoes during its propagation via the bone, β(n) is the gain or a filter that reduce the amount of ambient noise that is penetrated to the ear canal, and n2 is noise of the pickup equipment.

Conveniently, due to the fact that the "in ear" blocks the ear canal, the speech signal that is produced by the near end user and propagates via the bone, undergo an occlusion effect that increase the low frequencies of the speech by 15-20 db. This means that $\alpha>>1$ In addition the "in ear" blocks significantly the ambient noise, hence $\beta(n)<<1$.

Unlike standard system that uses two microphones. This fact enables us to outperform standard two microphones apparatus.

Figure 8:
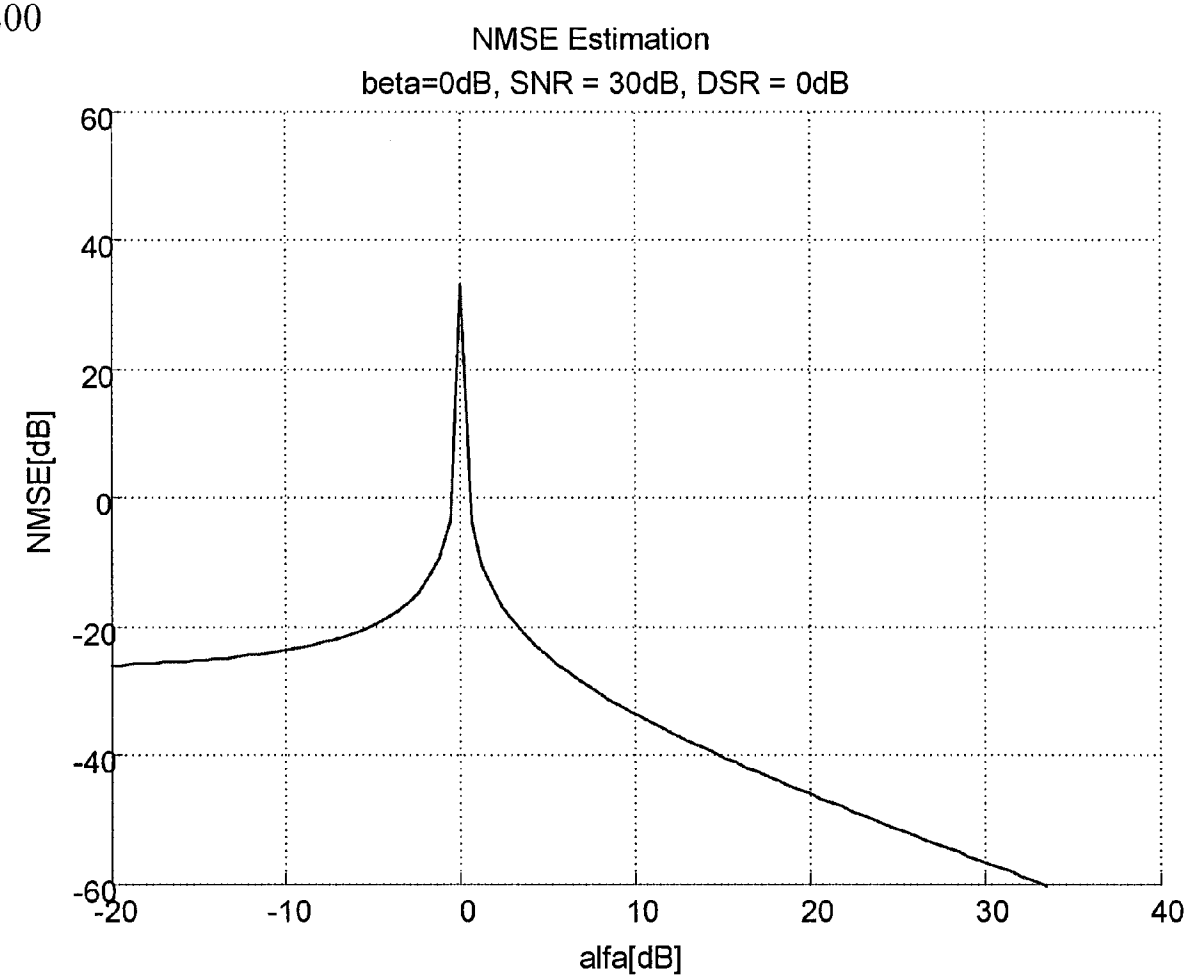
FIG. 8 illustrates a graph of NMSE estimation.

FIG. 8 illustrates graph 800 of NMSE estimation. Graph 800 depict MMSE versus $\alpha$ for $\beta$=0 db for S/N (speech to noise) ratio of 30 dB and S/D (speech to interference) ratio of 0 dB. As can be seen that for $\alpha$<0 db, MMSE will be in the range of −30 db, however if $\alpha$>−3 db the MMSE always will be lower than when $\alpha$<0 db, if $\alpha$ is around 20 db the MMSE will be around −45 db which provides a significant improvement compare the standard approach It must be noted that the systems described in 100, 400, 700, 900, 1100, can be used with standard headset instead of "in ear" speakers, in this cases the value of $\alpha$ and $\beta$ will be different and the cancellation process will be less effective.

According to an aspect of the invention, the invention discloses an apparatus that cancel ambient noise for the far end user by using a combination of "in ear" speakers, standard microphones and Bone conduction speakers or microphones.

According to an aspect of the invention, the invention discloses an apparatus that cancel ambient noise for the far end user and/or for the near end user by using a combination of "in ear" speakers, standard microphones and Bone conduction speakers or microphone.

According to an aspect of the invention, the invention discloses an apparatus that cancel ambient noise for the far end user by using a combination of "in ear" speakers with or without built-in microphones that reside in the ear and Standard external microphones.

According to an aspect of the invention, the invention discloses an apparatus that cancel ambient noise for the far end user and/or for the near end user by using a combination of "in ear" speakers with or without built-in microphones that resides in the ear and standard external microphones.

According to an aspect of the invention, the invention discloses a detector that the user is in silent, by analyzing the "in ear" speech signal According to an aspect of the invention, the invention discloses a detector that the user is in silent, by analyzing the speech that is detected by bone conduction microphone or bone conduction speaker. The analysis may be carried out, according to some embodiments of the invention, by calculating the energy of the signal or by analyzing the power amplitude per each frequency band.

According to an aspect of the invention, the invention discloses a mechanism that changes the adaptation parameters of the noise cancellation process and it depends if the near user speaks or is in silent.

According to an aspect of the invention, the invention discloses using bone speaker as a microphone and speaker at the same time.

According to an aspect of the invention, the invention discloses using "in ear" speaker as a microphone and speaker at the same time Referring to the herein offered aspects of the invention, it is noted that wherever "in ear" speaker a referred to, the invention can also be implemented using standard headset speakers instead of the "in ear" speakers, as well as other speakers that are known in the art.

Conveniently, at the near end, the user can decide if he wants to cancel the ambient noise d, and its self speech.

Conveniently, at the near end, the user can decide if he wants to cancel only part the ambient noise d.

Figure 9:
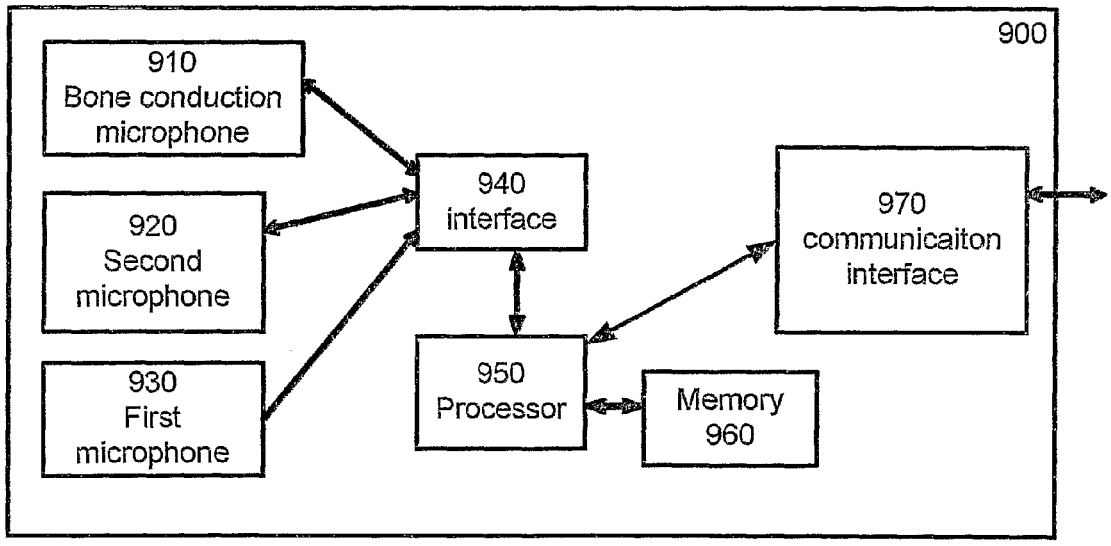
FIG. 9 illustrates a system for processing sound, according to an embodiment of the invention.

FIG. 9 illustrates system 900 for processing sound, according to an embodiment of the invention. It is noted that different embodiments of system 900 may implement different embodiments of systems 100, 300, 400, 500, and 600, and that different components of system 900 may implement different functionalities of those systems or of components thereof (either the parallel components—e.g. processor 950 for processor 150—or otherwise). Also, it is noted that according to several embodiments of the invention, system 900 may implement method 1000, or other methods herein disclosed, even if not explicitly elaborated.

System 900 includes processor 950 which is configured to process a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals.

It is noted that the detection moment is conveniently of short length. Referring to embodiments in which digital signals are processed, it is noted that the detection moment may include several samples of sounds, and may also include only one sample from each of the microphones.

It is noted that system 900 may and may not include the aforementioned microphones, as one or more of the microphones may be connected to system 900—either by wired or wireless connection. For example, while the first microphone may be, according to an embodiment of the invention, the regular microphone of a cellular phone that operates as system 900, the second microphone may be a speaker of headphones that are plugged into the cellular phone, while the bone conduction microphone may transmit information to the cellular phone wirelessly.

The microphones are denoted first microphone 930, second microphone 920, and bone conduction microphone 910. However, as aforementioned, not necessarily any of the microphones is included in system 900, and especially some of the microphones are conveniently external to a casing of system 900 in which processor 950 resides. The microphone may be connected to processor 950 via one or more intermediary interface 940. The intermediary interface may and may not pre-process any of the signals provided by any of the microphones.

It is noted that system 900 may be—according to different embodiments of the invention—a stand-alone system, incorporated into a system which have other functionalities (e.g. a cellular phone, a PDA, a computer, a vehicle-mounted system, a helmet, and so forth), and may be an add-on system, which enhance functionalities of another system. The components and functionalities of system 900 may also be divided between two or more systems that can interact with each other.

According to an embodiment of the invention, system 900 further includes memory 960, utilizable by processor 950 (e.g. for storing temporary information, executable code, calibration values, and so forth).

System 900 further includes communication interface 970, which is configured to provide the corrected signal to an external system. For example, the external system may be another cellular phone (or more precisely, a cellular network access device), a walkie-talkie, a computer-based telephony software, another chip (e.g. of a dedicated communication device), and so forth.

According to an embodiment of the invention, the second input signal is detected by the second microphone that is placed at least partly within an ear of a user. According to an embodiment of the invention, the second input signal is responsive to a sound signal that was modified within the ear canal, so that lower frequencies of the sound signal were amplified within the ear canal. Such modification may result, for example, from occlusion.

Occlusion is a well known phenomenon for hearing aids devices (also referred to as Occlusion effect). In hearing aids this effect degrades the performance of the device [e.g. Mark Ross, PhD, "The "Occlusion Effect"—what it is, and what to do about it", Hearing Loss (January/February 2004), http://www.hearingresearch.org/Dr.Ross/occlusion.htm]. According to an embodiment of the invention, the occlusion effect is utilized to improve signal-to-noise ratio that is detected by the second microphone. To explain the occlusion effect the following is a quote from the above reference.

"An occlusion effect occurs when some object (like an unvented earmold) completely fills the outer portion of the ear canal. What this does is trap the bone-conducted sound vibrations of a person's own voice in the space between the tip of the earmold and the eardrum. Ordinarily, when people talk (or chew) these vibrations escape through an open ear canal and the person is unaware of their existence. But when the ear canal is blocked by an earmold, the vibrations are reflected back toward the eardrum and increases the loudness perception of their own voice. Compared to a completely open ear canal, the occlusion effect may boost the low frequency (usually below 500 Hz) sound pressure in the ear canal by 20 dB or more."

According to an embodiment of the invention, one or more of the at least one second microphones utilized is an "in ear" microphone (which may also be a speaker) that close the air canal of the ear of the user, which creates the occlusion effect on the sound of the user's speaking. Thus, according to an embodiment of the invention, the cochlea receives the superposition of a sound arriving direct from the bone and a low frequency boosted version of the sound (due to the occlusion effect), which may be slightly delayed. According to an embodiment of the invention, the detection moment is long enough for the delayed version to be detected. Alternatively, according to an embodiment of the invention, the processor is further configured to process a past second signal that is detected by the second microphone in a moment preceded the detected moment, for the generation of the corrected signal.

According to an embodiment of the invention, the second microphone is also a speaker (e.g. of a headphones set) which is used to provide to the user sounds (which may be provided by system 900, or by another system). According to such an embodiment of the invention, the detection and sound providing by the second microphone may occur at least partially concurrently, or in an interchanging manner, depending for example on the type of microphone/speaker used.

According to an embodiment of the invention, system 900 further includes a second microphone interface (which may be a part of interface 940, but not necessarily so), which is connected to processor 950, for receiving the second input signal from the second microphone, wherein the second microphone interface is further for providing a sound signal to a speaker that is being used as the second microphone.

According to an embodiment of the invention, system 900 further includes a bone conduction microphone interface (which may be a part of interface 940, but not necessarily so), that is connected to processor 950, for receiving the third input signal from the third microphone, wherein the bone conduction microphone interface is further for providing a bone conductible sound signal to a bone conduction speaker that is being used as the bone conduction microphone.

According to an embodiment of the invention, the second microphone included in an ear plug that blocks the ear canal to ambient sound. The blocking is not necessarily complete blocking, but may also be a substantial reduction of ambient noise. Also, such substantial blocking is useful for reflecting sound signals within the ear-canal, thus aiding to the occlusion.

According to an embodiment of the invention, processor 950 is further configured to determine the corrected signal $\hat{S}(n)$ for the detection moment n, by a sum of convolutions $\hat{S}(n)=h_1(n)*M_1(n)+h_2(n)*M_2(n)+h_3(n)*M_3(n)$, wherein $M_1(n)$ represents the first input signal at the detection moment, $M_2(n)$ represents the second input signal at the detection moment, $M_3(n)$ represents the third input signal at the detection moment, and $h_1(n)$, $h_2(n)$, and $h_3(n)$ are calibration functions. Such implementation is discussed, for example, in relation to FIGS. 1 through 6.

According to an embodiment of the invention, processor 950 is further configured to update at least one calibration function in response to processing of input signals at a past moment that proceeds the detection moment. Such implementation is discussed, for example, in relation to FIGS. 1 through 6.

According to an embodiment of the invention, processor 950 is configured to selectively update the at least one calibration function for at least one past moment in which a speaking of a user is detected. Such implementation is discussed, for example, in relation to FIGS. 1 through 6. detecting speaking moments/frames is discussed, for example, in relation to FIGS. 2A and 2B.

It is noted that processor 950 (or other processor/speech detector of system 900) may be used for detecting a speaking of the user. This may be implemented, for example, by analyzing the volume of one or more of the first, second and/or third input signals. According to an embodiment of the invention, processor 950 (or a dedicated processor of system 900) is further configured to detect a speaking of a user in the past moment by analyzing a speaking spectrum of at least one of the first, second and third input signals. It is noted a speaking of a person may usually be characterized by a distinctive spectrum (and/or rhythm, or other parameters known in the art), and such parameters may be used to determine if the person is speaking. This may also be used for differentiating between speaking of the user to other background conversations. Also, it is noted that processor 950 (or the dedicated processor) may be trained to detect speaking of one or more individual users.

According to an embodiment of the invention, processor 950 is configured to update the at least one calibration function in response to an error function $\tilde{e}(n)$ the value of which for the detection moment n is determined by:

$$\tilde{e}(n)=\hat{\gamma}(n)*\tilde{s}(n)-M_3(n)$$

where $\tilde{s}(n)$ is a sum of $H_1(z)$, $H_2(z)$, and $H_3(z)$, wherein $H_i(z)$ is the Z-transform of the corresponding calibration function $h_i(n)$. Such implementation is discussed, for example, in relation to FIGS. 1 through 6.

According to an embodiment of the invention, processor 950 is further configured to update a calibration function $h_i(n)$ is responsive to a partial derivative of a mean square error function J with respect to the calibration function $h_i(n)$, to the error function $\tilde{e}(n)$, and to the respective input signal $M_i(n)$. Such implementation is discussed, for example, in relation to FIGS. 1 through 6.

According to an embodiment of the invention, processor 950 is further configured to process sound signals that are detected by multiple bone conduction microphones.

According to an embodiment of the invention, processor 950 is included in a mobile communication device (especially, according to an embodiment of the invention, in a casing thereof), which further includes the first microphone. Such a device may be, for example, a cellular phone, a Bluetooth headset, a wired headset, and so forth.

According to an embodiment of the invention, system 900 includes first microphone 930, which is configured to transduce an air-carried sound signal, for providing the first input signal.

According to an embodiment of the invention, system 900 further includes third microphone 910, which is configured to transduce a bone-carried sound signal from a bone of a user for providing the third input signal.

According to an embodiment of the invention, processor 950 is further configured to determine an ambient-noise estimation signal ($\tilde{d}(n)$), wherein system 900 further includes an interface (not illustrated) for providing to the user an audio signal that is processed in response to the ambient-noise estimation signal for reducing ambient noise interferences to the user. That is, the user may receive a sound signal (e.g. of his speech, of the other party speech, of an mp3 player, and so forth) from which ambient noise interferences were reduces. Such implementation is discussed, for example, in relation to FIGS. 1 through 6. it is noted that if the second microphone is also a speaker, the same interface may be used for both providing and receiving signals to/from the second microphone.

According to an embodiment of the invention, processor 950 is further configured to process an audio signal in response to the ambient-noise estimation signal for reducing ambient noise interferences to the user, wherein the processing of the audio signal is further responsive to a cancellation-level selected by a user of the system. The cancellation level may pertain, according to some embodiments of the invention, to cancellation of ambient noise (e.g. the user may wish to retain some ambient noise), to cancellation of the speaking of the user (e.g. the user may wish to receive more quite an echo of his speaking), or to both.

According to an embodiment of the invention, processor 950 is further configured to process the audio signal that is provided to the user via bone-conduction speakers in response to the ambient-noise estimation signal and in response to at least one bone-conductivity related parameter. Such implementation is discussed, for example, in relation to FIGS. 1 through 6 (and especially in relation to FIGS. 5 and 6).

According to an embodiment of the invention, processor 950 is further configured to update an adaptive noise reduction filter $W1(z)$, that is used by processor 950 for processing the audio signal that is provided to the user, in response to the second input signal, wherein the adaptive noise reduction filter $W1(z)$ corresponds to an estimated audial transformation of sound in an ear canal of the user. Such implementation is discussed, for example, in relation to FIGS. 1 through 6 (and especially in relation to FIGS. 5 and 6).

Figure 10:
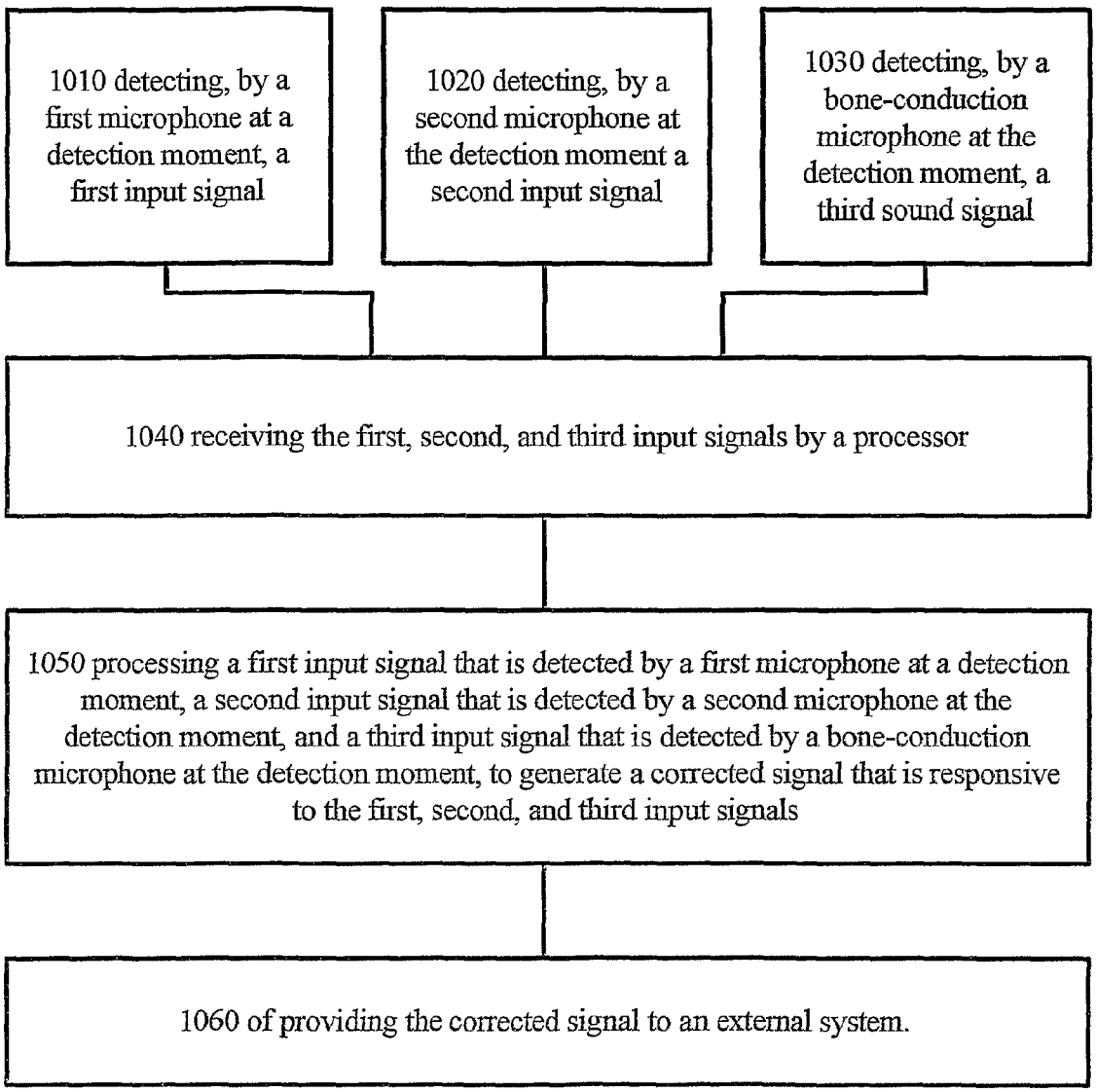
FIG. 10 illustrates a method for processing sound, according to an embodiment of the invention.

FIG. 10 illustrates method 1000 for processing sound, according to an embodiment of the invention. It is noted that method 1000 may be implemented by a system such as system 900 (which may be, for example, a cellular phone). Different embodiments of system 900, and of systems 100, 300, 400, 500, and 600, may be implemented by corresponding embodiments of method 1000, even if not explicitly elaborated.

Method 1000 may conveniently start with stages 1010, 1020, and 1030 of detecting, by a first microphone at a detection moment, a first input signal (1010); detecting, by a second microphone at the detection moment a second input signal (1020), and detecting, by a bone-conduction microphone at the detection moment, a third sound signal (1030). Referring to the examples set forth in the previous drawings, stage 1010 may be carried out by first microphone 930, stage 1020 may be carried out by second microphone 920, and stage 1013 may be carried out by bone conduction microphone 910.

Method 1000 may conveniently continue with stage 1040 of receiving the first, second, and third input signals by a processor. Referring to the examples set forth in the previous drawings, stage 1040 may be carried out by a processor such as processor 950 (which is conveniently a hardware processor, and/or a DSP processor).

Method 1000 continues (or starts) with stage 1050 of processing a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals. Referring to the examples set forth in the previous drawings, stage 1050 may be carried out by a processor such as processor 950 (which is conveniently a hardware processor, and/or a DSP processor).

Stage 1050 is followed by stage 1060 of providing the corrected signal to an external system. Referring to the examples set forth in the previous drawings, stage 1060 may be carried out by a communication interface such as communication interface 970 (which may conveniently be a hardware communication interface).

According to an embodiment of the invention, the processing is responsive to the second input signal that is detected by the second microphone that is placed at least partly within an ear of a user. Such implementation is discussed, for example, in relation to FIGS. 1 through 6.

According to an embodiment of the invention, the processing is responsive to the second input signal that is transduced by the second microphone from a sound signal that was modified within the ear canal, so that lower frequencies of the sound signal were amplified within the ear canal. Such implementation is discussed, for example, in relation to FIGS. 1 through 6.

According to an embodiment of the invention, the processing is responsive to the second input signal that is detected by the second microphone that is included in an ear plug that blocks the ear canal to ambient sound. Such implementation is discussed, for example, in relation to FIGS. 1 through 6.

According to an embodiment of the invention, the processing includes determining the corrected signal $\hat{S}(n)$ for the detection moment n, by a sum of convolutions $\hat{S}(n)=h1(n)*M1(n)+h2(n)*M2(n)+h3(n)*M3(n)$, wherein $M1(n)$ represents the first input signal at the detection moment, $M2(n)$ represents the second input signal at the detection moment, $M3(n)$ represents the third input signal at the detection moment, and $h1(n)$, $h2(n)$, and $h3(n)$ are calibration functions. Such implementation is discussed, for example, in relation to FIGS. 1 through 6.

According to an embodiment of the invention, the processing is preceded by updating at least one calibration function in response to processing of input signals at a past moment that proceeds the detection moment. Such implementation is discussed, for example, in relation to FIGS. 1 through 6.

According to an embodiment of the invention, the updating is selectively carried out for a past moment in which a speaking of a user is detected. Such implementation is discussed, for example, in relation to FIGS. 1 through 6.

It is noted that method 1000 may further include detecting a speaking of the user. This may be implemented, for example, by analyzing the volume of one or more of the first, second and/or third input signals. According to an embodiment of the invention, method 1000 further includes detecting a speaking of a user in the past moment by analyzing a speaking spectrum of at least one of the first, second and third input signals. It is noted a speaking of a person may usually be characterized by a distinctive spectrum (and/or rhythm, or other parameters known in the art), and such parameters may be used to determine if the person is speaking. This may also be used for differentiating between speaking of the user to other background conversations. Also, it is noted that the detecting may be responsive to training information for detecting speaking of one or more individual users.

According to an embodiment of the invention, the updating is responsive to an error function $\tilde{e}(n)$ the value of which for the detection moment n is determined by where $\tilde{s}(n)$ is a sum of H1($z$), H2($z$), and H3($z$), wherein Hi(z) is the Z-transform of the corresponding calibration function hi(n). Such implementation is discussed, for example, in relation to FIGS. 1 through 6.

According to an embodiment of the invention, the updating of a calibration function hi(n) is responsive to a partial derivative of a mean square error function J with respect to the calibration function hi(n), to the error function $\tilde{e}(n)$, and to the respective input signal Mi(n).

According to an embodiment of the invention, method 1000 further includes providing a sound signal to a speaker that is being used as the second microphone. Such implementation is discussed, for example, in relation to FIGS. 1 through 6.

According to an embodiment of the invention, method 1000 further includes providing a bone conductible sound signal to a bone conduction speaker that is being used as the bone conduction microphone. Such implementation is discussed, for example, in relation to FIGS. 1 through 6.

According to an embodiment of the invention, the processing includes processing sound signals that are detected by multiple bone conduction microphones. Such implementation is discussed, for example, in relation to FIGS. 1 through 6.

According to an embodiment of the invention, the processing is carried out by a processor that is included in a mobile communication device, which further includes the first microphone. Such implementation is discussed, for example, in relation to FIGS. 1 through 6.

According to an embodiment of the invention, the processing further includes determining an ambient-noise estimation signal, and processing an audio signal that is provided to the user is response to the ambient-noise estimation signal, for reducing ambient noise interferences to the user. Such implementation is discussed, for example, in relation to FIGS. 1 through 6.

According to an embodiment of the invention, the processing of the audio signal that is provided to the user for reducing ambient noise interferences is further responsive to a cancellation-level selected by a user of the system. The cancellation level may pertain, for example, to cancellation of ambient noise (e.g. the user may wish to retain some ambient noise), to cancellation of the speaking of the user (e.g. the user may wish to receive more quite an echo of his speaking), or to both.

According to an embodiment of the invention, method 1000 further includes processing the audio signal that is provided to the user via bone-conduction speakers in response to the ambient-noise estimation signal and in response to at least one bone-conductivity related parameter. Such implementation is discussed, for example, in relation to FIGS. 1 through 6.

According to an embodiment of the invention, the processing of the audio signal that is provided to the user for reducing ambient noise interferences includes updating an adaptive noise reduction filter W1($z$) that corresponds to an estimated audial transformation of sound in an ear canal of the user in response to the second input signal. Such implementation is discussed, for example, in relation to FIGS. 1 through 6.

Figure 11:
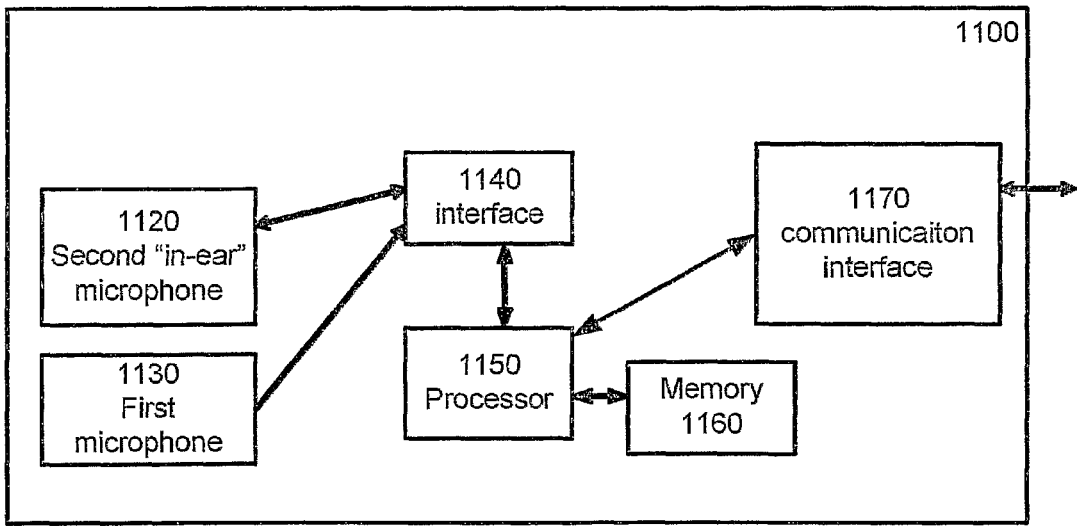
FIG. 11 illustrates a system for processing sound, according to an embodiment of the invention.

FIG. 11 illustrates system 1100 for processing sound, according to an embodiment of the invention. It is noted that different embodiments of system 1100 may implement different embodiments of system 700, and that different components of system 1100 may implement different functionalities of system 700 or of components thereof (either the parallel components—e.g. processor 1150 for processor 750—or otherwise). Also, it is noted that according to several embodiments of the invention, system 1100 may implement method 1200, or other methods herein disclosed, even if not explicitly elaborated.

System 1100 includes processor 1150 which is configured to process a first input signal that is detected by a first microphone at a detection moment, and a second input signal that is detected at the detection moment by a second microphone which is placed at least partly within an ear of a user, to generate a corrected signal that is responsive to the first, and the second input signals.

It is noted that the detection moment is conveniently of short length. Referring to embodiments in which digital signals are processed, it is noted that the detection moment may include several samples of sounds, and may also include only one sample from each of the microphones.

It is noted that system 1100 may and may not include the aforementioned microphones, as one or more of the microphones may be connected to system 1100—either by wired or wireless connection. For example, while the first microphone may be, according to an embodiment of the invention, the regular microphone of a cellular phone that operates as system 1100, the second microphone may be a speaker of headphones that are plugged into the cellular phone. Such implementation is discussed, for example, in relation to FIG. 7.

The microphones are denoted first microphone 1130, and second "in-ear" microphone 1120. However, as aforementioned, not necessarily any of the microphones is included in system 1100, and especially some of the microphones are conveniently external to a casing of system 1100 in which processor 1150 resides. The microphone may be connected to processor 1150 via one or more intermediary interface 1140. The intermediary interface may and may not pre-process any of the signals provided by any of the microphones.

It is noted that system 1100 may be—according to different embodiments of the invention—a stand-alone system, incorporated into a system which have other functionalities (e.g. a cellular phone, a PDA, a computer, a vehicle-mounted system, a helmet, and so forth), and may be an add-on system, which enhance functionalities of another system. The components and functionalities of system 1100 may also be divided between two or more systems that can interact with each other.

According to an embodiment of the invention, system 1100 further includes memory 1160, utilizable by processor 1150 (e.g. for storing temporary information, executable code, calibration values, and so forth).

System 1100 further includes communication interface 1170, which is configured to provide the corrected signal to an external system. For example, the external system may be another cellular phone (or more precisely, a cellular network access device), a walkie-talkie, a computer-based telephony software, another chip (e.g. of a dedicated communication device), and so forth.

Conveniently, the second input signal is detected by the second microphone that is placed at least partly within an ear of a user. According to an embodiment of the invention, the second input signal is responsive to a sound signal that was modified within the ear canal, so that lower frequencies of the sound signal were amplified within the ear canal. Such modification may result, for example, from occlusion. Such implementation is discussed, for example, in relation to FIG. 7.

According to an embodiment of the invention, one or more of the at least one second microphones utilized is an "in ear" microphone (which may also be a speaker) that close the air canal of the ear of the user, which creates the occlusion effect on the sound of the user's speaking. Thus, according to an embodiment of the invention, the cochlea receives the superposition of a sound arriving direct from the bone and a low frequency boosted version of the sound (due to the occlusion effect), which may be slightly delayed. According to an embodiment of the invention, the detection moment is long enough for the delayed version to be detected. Alternatively, according to an embodiment of the invention, the processor is further configured to process a past second signal that is detected by the second microphone in a moment preceded the detected moment, for the generation of the corrected signal. Such implementation is discussed, for example, in relation to FIG. 7.

According to an embodiment of the invention, the second microphone is also a speaker (e.g. of a headphones set) which is used to provide to the user sounds (which may be provided by system 1100, or by another system). According to such an embodiment of the invention, the detection and sound providing by the second microphone may occur at least partially concurrently, or in an interchanging manner, depending for example on the type of microphone/speaker used. Such implementation is discussed, for example, in relation to FIG. 7.

According to an embodiment of the invention, system 1100 further includes a second microphone interface (which may be a part of interface 1140, but not necessarily so), which is connected to processor 1150, for receiving the second input signal from the second microphone, wherein the second microphone interface is further for providing a sound signal to a speaker that is being used as the second microphone. Such implementation is discussed, for example, in relation to FIG. 7.

System 1100 includes communication interface 1170 for providing the corrected signal to an external system.

According to an embodiment of the invention, both of the first and the second input signals reflect a superposition of signals responsive to a user speech signal and an ambient noise signal, wherein the second input signal is substantially more responsive to the user speech signal and substantially less responsive to the ambient noise signal, compared to the first sound signal. Such implementation is discussed, for example, in relation to FIG. 7.

According to an embodiment of the invention, processor 1150 is further configured to determine an ambient-noise estimation signal, wherein system 1100 further includes an interface for providing to the user an audio signal that is processed in response to the ambient-noise estimation signal for reducing ambient noise interferences to the user. Such implementation is discussed, for example, in relation to FIG. 7.

Figure 12:
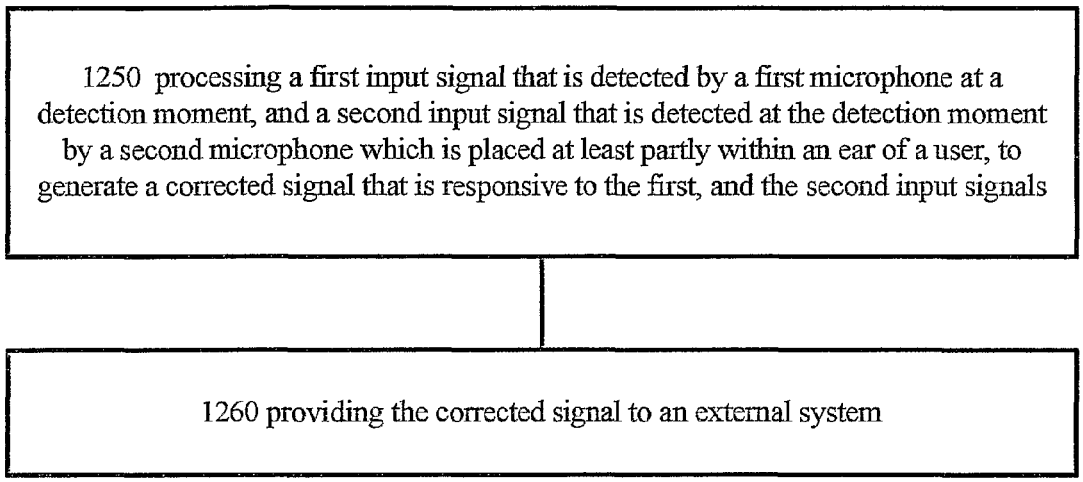
FIG. 12 illustrates a method for processing sound, according to an embodiment of the invention.

FIG. 12 illustrates method 1200 for processing sound, according to an embodiment of the invention. It is noted that method 1200 may be implemented by a system such as system 1100 (which may be, for example, a cellular phone). Different embodiments of systems 700 and 900 may be implemented by corresponding embodiments of method 1000, even if not explicitly elaborated.

Method 1200 may conveniently start with detecting, by a first microphone at a detection moment, a first input signal; and/or detecting, by a second microphone at the detection moment a second input signal. Referring to the examples set forth in the previous drawings, the detecting may be carried out by at least one or the first or second microphones 1130, 1120.

Method 12000 may conveniently continue with receiving the first and the second input signals by a processor. Referring to the examples set forth in the previous drawings, the receiving may be carried out by a processor such as processor 1150 (which is conveniently a hardware processor, and/or a DSP processor).

Method 1200 continues (or starts) with stage 1250 of processing (conveniently by a hardware processor) a first input signal that is detected by a first microphone at a detection moment, and a second input signal that is detected at the detection moment by a second microphone which is placed at least partly within an ear of a user, to generate a corrected signal that is responsive to the first, and the second input signals. Referring to the examples set forth in the previous drawings, stage 1250 may be carried out by a processor such as processor 1150 (which is conveniently a hardware processor, and/or a DSP processor).

Stage 1250 is followed by stage 1260 of providing the corrected signal to an external system. Referring to the examples set forth in the previous drawings, stage 1250 may be carried out by a communication interface such as communication interface 1170 (which is conveniently a hardware communication interface).

According to an embodiment of the invention, stage 1250 includes processing the first input signal and the second input signal, wherein both of the first and the second input signals reflect a superposition of signals responsive to a user speech signal and an ambient noise signal, wherein the second input signal is substantially more responsive to the user speech signal and substantially less responsive to the ambient noise signal, compared to the first sound signal.

According to an embodiment of the invention, stage 1250 further includes determining an ambient-noise estimation signal, and processing an audio signal that is provided to the user is response to the ambient-noise estimation signal, for reducing ambient noise interferences to the user.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A system for processing sound, the system comprising:

a processor, configured to process a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals; and a communication interface, configured to provide the corrected signal to an external system; wherein the processor is further configured to determine the corrected signal $\hat{S}(n)$ for the detection moment n, by a sum of convolutions $\hat{S}(n)=h_1(n)*M_1(n)+h_2(n)*M_2(n)+h_3(n)*M_3(n)$, wherein $M_1(n)$ represents the first input signal at the detection moment, $M_2(n)$ represents the second input signal at the detection moment, $M_3(n)$ represents the third input signal at the detection moment, and $h_1(n)$, $h_2(n)$, and $h_3(n)$ are calibration functions.

2. The system of claim 1, wherein the second input signal is detected by the second microphone which is placed at least partly within an ear of a user.

3. The system of claim 2, wherein the second input signal is responsive to a sound signal which was modified within the ear canal, so that lower frequencies of the sound signal were amplified within the ear canal.

4. The system of claim 2, wherein the second microphone is comprised in an ear plug that blocks the ear canal to ambient sound.

5. The system of claim 1, wherein the processor is further configured to update at least one calibration function in response to processing of input signals at a past moment that precedes the detection moment.

6. The system of claim 5, wherein the processor is configured to selectively update the at least one calibration function for at least one past moment in which a speaking of a user is detected.

7. The system of claim 6, wherein the processor is further configured to detect a speaking of a user in the past moment by analyzing a speaking spectrum of at least one input signal.

8. The system of claim 5, wherein the processor is configured to update the at least one calibration function in response to an error function $\tilde{e}(n)$ the value of which for the detection moment n is determined by $\tilde{e}(n)\approx\hat{\gamma}(n)*\tilde{s}(n)-M_3(n)$ where $\tilde{s}(n)$ is a sum of $H_1(z)$, $H_2(z)$, and $H_3(z)$, wherein $H_i(z)$ is the Z-transform of the corresponding calibration function $h_i(n)$.

9. The system of claim 5, wherein the processor is further configured to update a calibration function $h_i(n)$ is responsive to a partial derivative of a mean square error function J with respect to the calibration function $h_i(n)$, to the error function $\tilde{e}(n)$, and to the respective input signal $M_i(n)$.

10. The system of claim 1, further comprising a second microphone interface, coupled to the processor, for receiving the second input signal from the second microphone, wherein the second microphone interface is further for providing a sound signal to a speaker that is being used as the second microphone.

11. The system of claim 1, further comprising a bone conduction microphone interface, coupled to the processor, for receiving the third input signal from the third microphone, wherein the bone conduction microphone interface is further for providing a bone conductible sound signal to a bone conduction speaker that is being used as the bone conduction microphone.

12. The system of claim 1, wherein the processor is further configured to process sound signals that are detected by multiple bone conduction microphones.

13. The system of claim 1, wherein the processor is comprised in a mobile communication device, which further comprises the first microphone.

14. The system of claim 1, further comprising the first microphone, which is configured to transduce an air-carried sound signal, for providing the first input signal.

15. The system of claim 1, further comprising third microphone, that is configured to transduce a bone-carried sound signal from a bone of a user for providing the third input signal.

16. The system of claim 1, wherein the processor is further configured to determine an ambient-noise estimation signal, wherein the system further comprises an interface for providing to the user an audio signal that is processed in response to the ambient-noise estimation signal for reducing ambient noise interferences to the user.

17. The system of claim 16, wherein the processor is further configured to process the audio signal that is provided to the user via bone-conduction speakers in response to the ambient-noise estimation signal and in response to at least one bone-conductivity related parameter.

18. The system of claim 16, wherein the processor is further configured to update an adaptive noise reduction filter W1(*z*), that is used by the processor for processing the audio signal that is provided to the user, in response to the second input signal, wherein the adaptive noise reduction filter W1(*z*) corresponds to an estimated audial transformation of sound in an ear canal of the user.

19. The system of claim 16, wherein the processor is further configured to process an audio signal in response to the ambient-noise estimation signal for reducing ambient noise interferences to the user, wherein the processing of the audio signal is further responsive to a cancellation-level selected by a user of the system.

20. A method for processing sound, the method comprising:

processing a first input signal that is detected by a first microphone at a detection moment, a second input signal that is detected by a second microphone at the detection moment, and a third input signal that is detected by a bone-conduction microphone at the detection moment, to generate a corrected signal that is responsive to the first, second, and third input signals; and providing the corrected signal to an external system; wherein the processing comprises determining the corrected signal $\hat{S}(n)$ for the detection moment n, by a sum of convolutions $\hat{S}(n)=h_1(n)*M_1(n)+h_2(n)*M_2(n)+h_3(n)*M_3(n)$, wherein $M_1(n)$ represents the first input signal at the detection moment, $M_2(n)$ represents the second input signal at the detection moment, $M_3(n)$ represents the third input signal at the detection moment, and $h_1(n)$, $h_2(n)$, and $h_3(n)$ are calibration functions.

21. The method of claim 20, wherein the processing is responsive to the second input signal which is detected by the second microphone which is placed at least partly within an ear of a user.

22. The method of claim 21, wherein the processing is responsive to the second input signal which is transduced by the second microphone from a sound signal which was modified within the ear canal, so that lower frequencies of the sound signal were amplified within the ear canal.

23. The method of claim 21, wherein the processing is responsive to the second input signal which is detected by the second microphone that is comprised in an ear plug that blocks the ear canal to ambient sound.

24. The method of claim 20, wherein the processing is preceded by updating at least one calibration function in response to processing of input signals at a past moment that precedes the detection moment.

25. The method of claim 24, wherein the updating is selectively carried out for a past moment in which a speaking of a user is detected.

26. The method of claim 25, further comprising detecting a speaking of a user in the past moment by analyzing a speaking spectrum of at least one input signal.

27. The method of claim 24, wherein the updating is responsive to an error function $\tilde{e}(n)$ the value of which for the detection moment n is determined by $\tilde{e}(n)\approx\hat{\gamma}(n)*\tilde{s}(n)-M_3(n)$ where $\tilde{s}(n)$ is a sum of $H_1(z)$, $H_2(z)$, and $H_3(z)$, wherein $H_i(z)$ is the Z-transform of the corresponding calibration function $h_i(n)$.

28. The method of claim 24, wherein the updating of a calibration function $h_i(n)$ is responsive to a partial derivative of a mean square error function J with respect to the calibration function $h_i(n)$, to the error function $\tilde{e}(n)$, and to the respective input signal $M_i(n)$.

29. The method of claim 20, further comprising providing a sound signal to a speaker that is being used as the second microphone.

30. The method of claim 20, further comprising providing a bone conductible sound signal to a bone conduction speaker that is being used as the bone conduction microphone.

31. The method of claim 20, wherein the processing comprises processing Sound signals that are detected by multiple bone conduction microphones.

32. The method of claim 20, wherein the processing is carried out by a processor which is comprised in a mobile communication device, which further comprises the first microphone.

33. The method of claim 20, wherein the processing further comprises determining an ambient-noise estimation signal, and processing an audio signal that is provided to the user is response to the ambient-noise estimation signal, for reducing ambient noise interferences to the user.

34. The method of claim 33, further comprising processing the audio signal that is provided to the user via bone-conduction speakers in response to the ambient-noise estimation signal and in response to at least one bone-conductivity related parameter.

35. The method of claim 33, wherein the processing of the audio signal that is provided to the user for reducing ambient noise interferences comprises updating an adaptive noise reduction filter $W1(z)$ that corresponds to an estimated audial transformation of sound in an ear canal of the user in response to the second input signal.

36. The method of claim 33, wherein processing of the audio signal that is provided to the user for reducing ambient noise interferences is further responsive to a cancellation-level selected by a user of the system.

* * * * *